United States Patent [19]

Fleischer

[11] Patent Number: 4,950,975

[45] Date of Patent: Aug. 21, 1990

[54] PRELIMINARY STAGE OF A VOLTAGE REGULATOR WITH LOW LOSS OF VOLTAGE, AND VOLTAGE REGULATOR WITH SAID PRELIMINARY STAGE

[75] Inventor: Ulrich Fleischer, Pliezhausen, Fed. Rep. of Germany

[73] Assignee: Robert Bosch GmbH, Stuttgart, Fed. Rep. of Germany

[21] Appl. No.: 399,481

[22] PCT Filed: Feb. 18, 1988

[86] PCT No.: PCT/DE88/00081

§ 371 Date: Aug. 16, 1989

§ 102(e) Date: Aug. 16, 1989

[87] PCT Pub. No.: WO88/06757

PCT Pub. Date: Sep. 7, 1988

[30] Foreign Application Priority Data

Mar. 4, 1987 [DE] Fed. Rep. of Germany ..... 3706907

[51] Int. Cl.[5] ..... G05F 1/563

[52] U.S. Cl. ..... 323/266; 323/276; 323/277; 323/279

[58] Field of Search ..... 323/266, 273, 274, 275, 323/276, 277, 279, 280

[56] References Cited

U.S. PATENT DOCUMENTS

| | | | |
|---|---|---|---|
| 3,048,718 | 8/1962 | Starzec et al. | 307/93 |
| 3,373,344 | 3/1968 | Seer | 323/266 |
| 3,946,303 | 3/1976 | Streit et al. . | |
| 4,495,536 | 1/1985 | Bynum | 323/277 |
| 4,684,878 | 8/1987 | Giordano | 323/279 |
| 4,731,574 | 3/1988 | Melbert et al. | 323/275 |

FOREIGN PATENT DOCUMENTS

| | | |
|---|---|---|
| 251403 | 1/1988 | European Pat. Off. . |
| 2427376 | 12/1974 | Fed. Rep. of Germany . |
| 2625307 | 12/1977 | Fed. Rep. of Germany . |
| 2183695 | 12/1973 | France . |
| 1579326 | 11/1980 | United Kingdom . |

OTHER PUBLICATIONS

Ciscato et al., "Supply Regulation in Automotive Electronics", New Electronics, vol. 18, No. 10, pp. 77, 8, May 14, 1985.

Thomson, Semiconductors, "Low Dropout Voltage Regulator (TEA 7034", (undated).

National Semiconductor, "LM2935 Low Dropout Voltage Dual Regulator", Mar. 1983.

SGS, "Very Low Drop Voltage Regulators (L387)", 1981.

SGS, "Very Low Drop SV Voltage Regulator", L487), 1982.

*Primary Examiner*—William H. Beha, Jr.

*Attorney, Agent, or Firm*—Michael J. Striker

[57] ABSTRACT

A preliminary stage of a voltage regulator with a low voltage loss to be connected with a further stage of the voltage regulator and comprising an input and output voltage terminals, a common voltage terminal for input voltage and output voltage, a capacitor serving as a charge storage element at an output side of the series preliminary stage, a branch including a transistor having an emitter connected with the input voltage terminal, a collector connected with the output voltage terminal, and an auxiliary collector; a power means for feeding the transistor with a base current, and a current reducing element for reducing current flowing in the capacitor to zero before the transistor reaches saturation when the input voltage and the output voltage falls below a predetermined amount, and including an element for influencing a potential of the collector and connected with the auxiliary collector and the input voltage terminal, and a voltage regulator containing such a preliminary stage.

8 Claims, 5 Drawing Sheets

FIG. 3
PRIOR ART
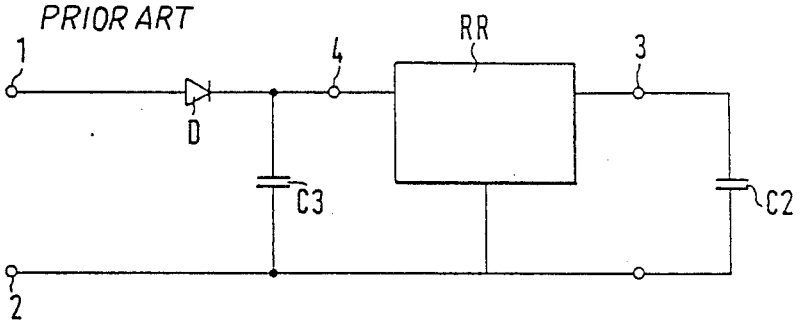
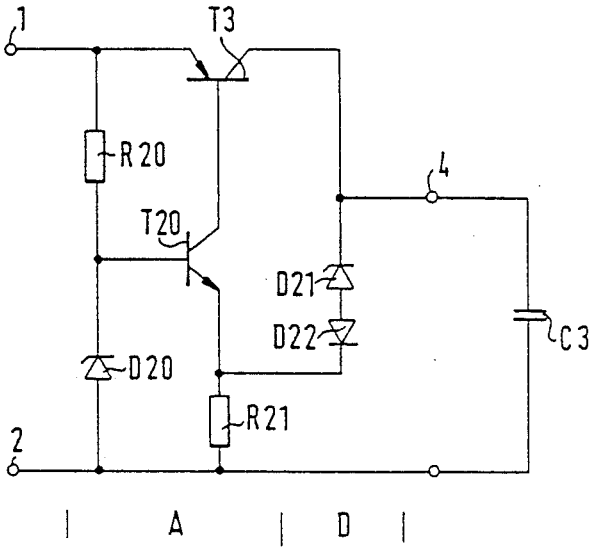
FIG. 5

PRELIMINARY STAGE OF A VOLTAGE REGULATOR WITH LOW LOSS OF VOLTAGE, AND VOLTAGE REGULATOR WITH SAID PRELIMINARY STAGE

BACKGROUND OF THE INVENTION

The invention relates to a preliminary stage of a voltage regulator, and a voltage regulator with the preliminary stage.

Preliminary stages of voltage regulators and voltage regulators themselves, respectively, are already known, in which the charging current flowing in the capacitor, which serves as charge storage element on the output side, is reduced to zero when a series transistor reaches saturation. However, these arrangements have the disadvantage that the series transistor also carries a very high base current, which makes the regulator unsuitable for standby operation.

SUMMARY OF THE INVENTION

The object of the invention is a preliminary stage of a voltage regulator, which has the advantage that the increase in the base current of the series transistor is prevented during the reduction of the charging current of the capacitor in the event that the voltage difference between the input voltage and the output voltage falls below a predetermined amount, and which makes possible an efficient standby operation.

The object of the invention is achieved by providing a device which reduces the current flowing in the capacitor to zero before the series transistor reaches saturation when the input and output voltages fall below a predetermined magnitude.

The present invention both as to its construction so to its mode of operation, together with additional objects and advantages thereof, will be best understood from the following detailed description of preferred embodiments with reference to the appended drawings.

BRIEF DESCRIPTION OF THE DRAWINGS

FIG. 3 shows a known supplemental wiring of a low-drop regulator for a charge storage;

FIG. 5 shows an embodiment of a known low-drop preliminary stage of a voltage regulator;

DETAILED DESCRIPTION OF THE PREFERRED EMBODIMENTS

Voltage regulators for achieving the lowest possible voltage losses between the input and output voltage are known by a characterizing designations of "low-drop regulators" or "very-low-drop regulators" (e.g. L487, L387, etc. -SGS; TEA 7034-Thomson; LM2935-NS). They are used in motor vehicle electronic circuits, among other things, in order to ensure a sufficient 5V feeding of the vehicle electronic devices when the vehicle voltage drops to approximately 6V under starting load. Conventional drop voltages (minimum necessary voltage difference between input and output voltage) of such regulators lie between 0.6V and 1V.

Figure 1:
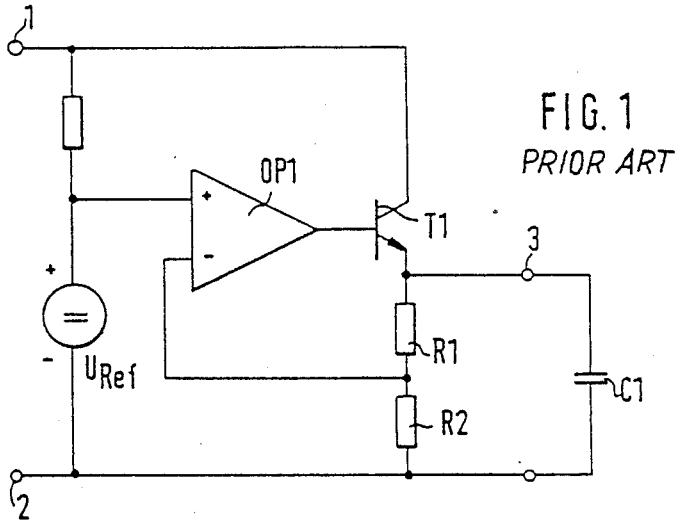
FIG. 1 PRIOR ART
FIG. 1 shows a known voltage regulator basic circuit.

Voltage regulators without low-drop characteristic (basic view in FIG. 1) work, in the regulator series arm or branch, with a power transistor T1 in voltage follower circuit (emitter follower) i.e., the emitter of the transistor T1 is at the output terminal 3 of the regulator on the load side and, accordingly, introduces no additional voltage amplification into the closed control loop (emitter T1; feedback divider R1, R2; inverting input of OP1; output of OP1 and base of T1). The internal frequency compensation of the operational amplifier OP1 controlling the final stage transistor, as described e.g. in US-PS 39 46 303, is sufficient for the stability of such regulators. The capacitor C1 parallel to the load terminals 2, 3 serves in this instance only as a charge storage for buffering the pulse loads which the regulator may not be able to level quickly enough. The regulator itself works in a stable manner also without the capacitor C1.

Figure 2:
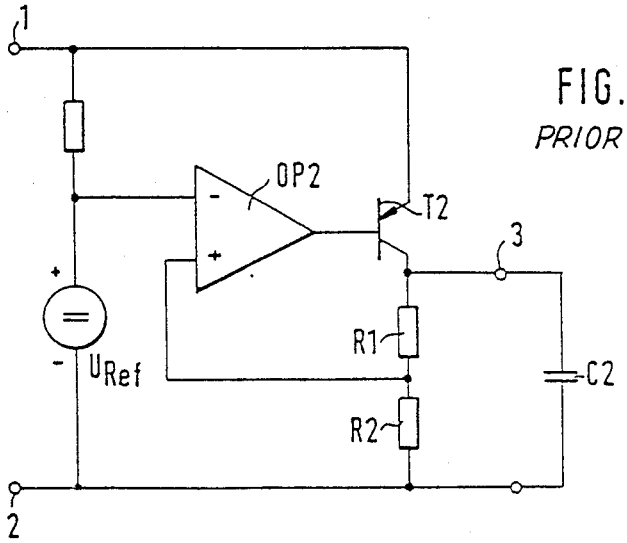
FIG. 2 PRIOR ART
FIG. 2 shows a known low-drop voltage regulator basic circuit.

In contrast, the power transistor T2 lies in the series arm or branch of the voltage regulator of the low-drop type (basic view in FIG. 2) with its collector on the load side (terminal 3) and with its emitter on the input side (terminal 1). Thus, it works on the load as a voltage amplifier in the emitter basic circuit and accordingly introduces an additional voltage amplification (with generally very unfavorable position of the pole frequency) into the closed control loop. The internal frequency compensation of the controlling operational amplifier OP2 is no longer sufficient for the stability of these regulators. The internal compensation of the operational amplifier can now even be disadvantageous, since there should preferably be only a single location in the closed control loop at which the higher-frequency components of the transmission function of the open control loop are reduced with a defined rate of 20 dB per frequency decade (single-pole RC low-pass response for the open loop).

The capacitor C2 is used parallel to the load terminals 2, 3 as compensation means for the low-drop regulators, since this capacitor is generally provided in any event in its capacity as charge storage (load buffer). However, for reasons relating to the stability of the regulator, it is now necessary in a minimum amount of 10 $\mu$F to 20 $\mu$F. As a result, expensive tantalum electrolytic capacitors must be used for operating at low temperatures (motor vehicle use down to $-40°$ C.), since the series resistances occurring in aluminum electrolytic capacitors in cold weather cause a decoupling of the capacitive load of the control loop, which leads to the instability of the regulators. In addition, the minimum values for C2 described above are, in many cases of application, greater than would be necessary in accordance with the actual purpose of the charge storage.

When using low-drop regulators in motor vehicle supply systems, additional (expensive) external connecting elements are used almost without exception in order to keep the effects of positive and negative voltage peaks in the vehicle supply system at a distance from the re output and to guarantee a continuous voltage feeding of the components supplied by the low-drop regulator. In so doing, the actual main charge storage is readily placed at the input of the regulator for reasons which will become clear below, and only smaller filtering capacitors would be necessary for pulse buffering at the regulator output if the minimum values of C2 were not necessary for reasons relating to stability. This is particularly troublesome if a plurality of regulators are operated from a main charge storage (standby regulator for RAM supply, main regulator for processors and processor peripherals, additional regulators for linear circuit groups).

An input circuit according to FIG. 3 is possible (see DE-OS No. 30 29 696). A capacitor C3 serving as main charge storage 1 is charged via a diode D almost to a vehicle voltage, so that the regulator RR is supplied in intervals of negatively transient vehicle voltages from C3. ΔU.C3 is available as charge reserve, wherein ΔU is the difference in voltages at C3 (approximately 13V) and at C2 (5 V) minus the regulator drop voltage (approximately 0.75 V), that is, $\Delta U \approx 7$ V. This charge reserve is substantially greater than it could be at the same expenditure at the regulator outputs. The diode D prevents the reverse discharge of C3 in the vehicle supply system. In addition to the additional expenditure, another disadvantage of the arrangement is a drop voltage of 0.7 V which is increased by the voltage drop at D.

According to the invention, the described disadvantages are eliminated without losing the low-drop characteristics or the comprehensive protection against disturbances in the supply system. In addition, the use of inexpensive external components (particularly aluminum electrolytic capacitors) down to temperatures of −40° C. is made possible. In addition, the possibility is provided that a plurality of regulator stages connected subsequent to the preliminary stage can be supplied from a main charge storage without minimum values for the charge storage on the load side having to be prescribed for reasons of stability.

Figure 6:
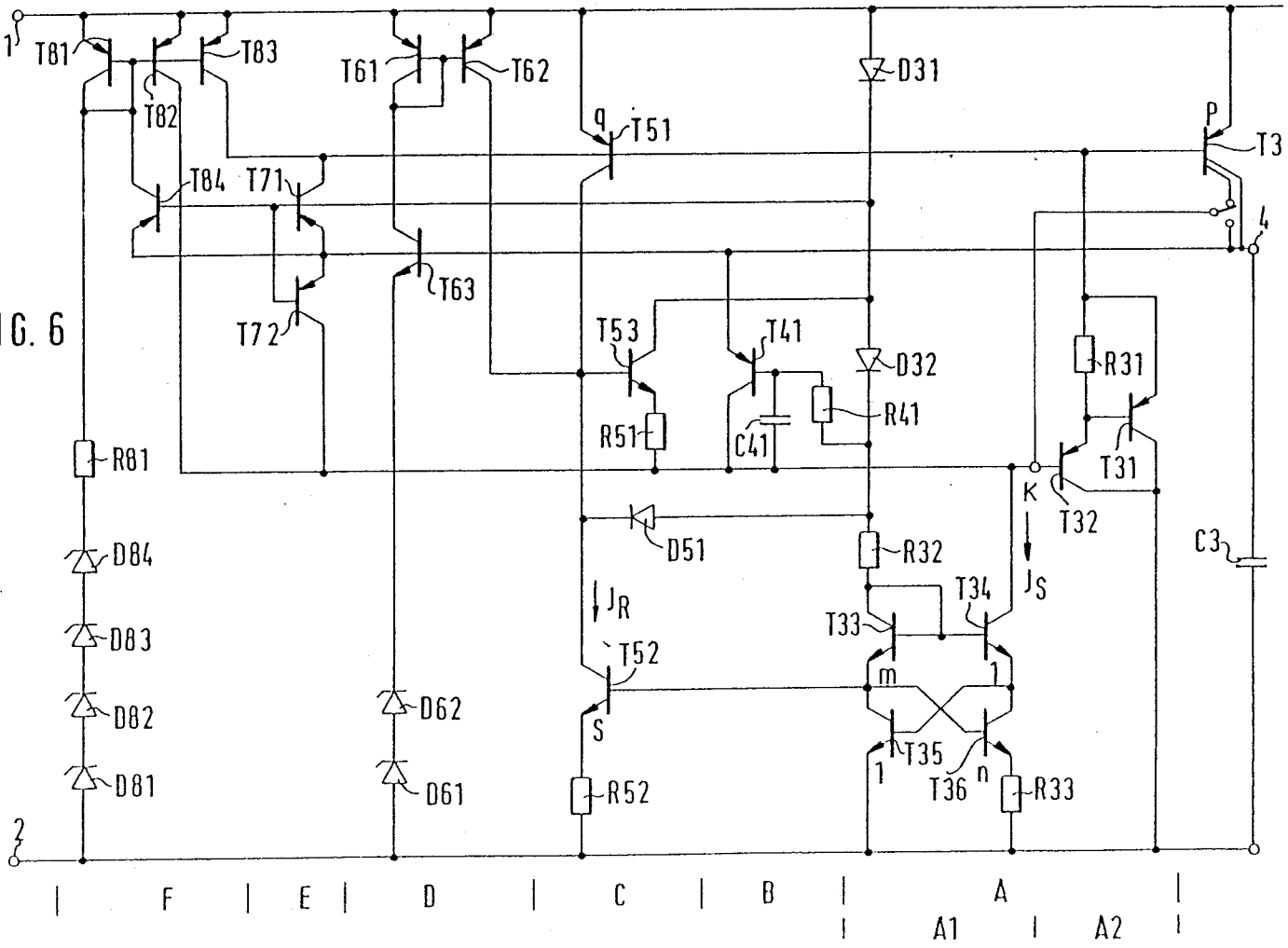
FIG. 6 shows an embodiment of a low-drop preliminary stage of a voltage regulator, according to the invention.

The solution, according to the invention, is achieved by in a preliminary stage VS with low-drop characteristic, e.g. according to FIG. 6, which charges the main charge storage C3 up to a voltage which can be determined by its construction. In addition, subsequent regulator stages RS1, RS2, . . . RSn, preferably of the type according to FIG. 1, can be provided in desired quantities. In contrast to the regulator type according to FIG. 1, these stages preferably obtain a special base current supply for the longitudinal transistor T1 (T11, T12, etc. in FIG. 4) with devices G (G1, G2, etc.), which can take off the base current from the charge storage C3 as well as directly from (at low supply voltage) the supply voltage at the terminal 1 in order to obtain the low-drop characteristics.

The preliminary stage VS has the following tasks:

(a) Charging the capacitor C3 (main charge storage) until a maximum voltage $U_{3max}$ which is predetermined by the construction (e.g. 14 V) when the supply voltage at the terminal 1 is sufficient for this. The voltage $U_{3max}$ is also not to be exceeded at very high supply voltages.

(b) Charging the capacitor C3 to the highest possible voltage $U_3$ when the supply voltage at terminal 1 is insufficient, in order to achieve the value $U_{3max}$ for $U_3$. The remaining (smallest possible) voltage difference by which $U_3$ must remain smaller than the supply voltage at the terminal 1, can be determined by the construction. In at advantageous manner, it remains somewhat greater than the collector-emitter saturation residual voltage of the transistor T3.

(c) Terminating the charging process at the attainable charging end voltage $U_3$ and $U_{3max}$, respectively, by reduction of the collector current of T3 to the amount of the load current which flows off parallel to C3.

(d) Limiting the inherent current consumption of the preliminary stage VS in operation without external load to negligible values ($<1\%\phi$ of the rated load current which can be taken off externally). This characteristic distinguishes the solution according to the invention from known preliminary stages (FIG. 5) and is of decisive importance for the standby operation in which the connection terminal 1 may only take off the current which is absolutely necessary for the standby operation and is as small as possible, e.g. in order to discharge the battery of a turned off motor vehicle no more than is unavoidable.

(e) Blocking the emitter-collector current of T3 for the normal operation of this transistor when the supply voltage at the connection 1 exceeds a value (e.g. 26 V) which can be determined by the construction, and blocking the collector-emitter current of T3 for inverse operation when the supply voltage at the connection 1 becomes smaller than the instantaneous charging voltage $U_3$ at C3.

(f) Limiting the collector current of T3 to a maximum current which is predetermined by means of the construction.

These characteristics provide the foundation for an energy supply of electronic components which is free of disturbances in the power supply system without having to cope with the disadvantages of known arrangements (e.g. incomplete preliminary stage according to FIG. 5—see below).

In order to produce these characteristics, devices are necessary which are described below and explained more exactly by means of embodiment.

However, a known preliminary stage (FIG. 5) will be discussed beforehand so as to refer to the familiar scheme and facilitate the comparison with the solution according to the invention.

The resistor R20, the Zener diode D20, the transistor T20 and the resistor R21 produce a base current for the transistor T3 in the series branch of the preliminary stage (corresponds to a device A—see below), which base current is determined by construction. The collector current of T3 charges the capacitor C3 (main charge storage) up to a maximum voltage $U_{3max}$ determined by the construction which is not exceeded (corresponds to a device D—see below). At this voltage $U_{3max}$, the diode branch consisting of diode D22 and Zener diode D21 carries just enough current via the resistor R21 so that T20 can supply the base current for T3 which suffices to maintain the current in the diode branch D21, D22. Thus, $U_{3max}$ is substantially determined by the sum of the Zener voltages of D20 and D21. This preliminary stage contains no devices B, C, E and F according to the invention (see below).

An embodiment of a device, according to the invention, has the preliminary stage according to FIG. 6.

The object of the device A is to supply the transistor T3 in the series branch of the preliminary stage with base current in such a way that the collector of T3 can supply the maximum load current required at terminal 4. Every preliminary stage must contain such a device A in some form (compare the preliminary stage according to FIG. 5). For this reason, the existence of a device A is also not in itself a component part of the invention as are, however, particularly advantageous embodiments of the device A which contain the following additional feature:

There is at least one branch point K within the device A at which two partial devices A1 and A2 are connected with one another, wherein the partial device A1 guides off a control current $I_s$ from the branch point K to the terminal 2 of the supply system, which control current $I_s$ is determined by the construction and is as small as possible, and wherein the partial device A2 is a current amplifier which connects the branch point K with the base of the transistor T3 in such a way that, in the absence of other influences of the devices B, C, D, E and F of the preliminary stage, the base current fed to the base of T3 is the product of the aforementioned control current $I_s$ of the partial device A1 and the current amplification factor of the partial device A2.

In the embodiment (FIG. 6), the device A2 (current amplifier) is shown as a two-stage collector basic circuit with the two transistors T31 and T32 and the resistor R31 which is known as Darlington circuit. It could also be a three- or multiple-stage collector basic circuit or another desired current amplifier circuit (voltage follower circuit), wherein the other devices B, C, D, E and F would, of course, have to be adapted to the selected current amplifier circuit in such a way as to maintain their function. The device A1 is constructed as a so-called cross-coupled ring current source, likewise known, with the transistors T33, T34, T35 and T36 and the resistor R33. An input current is fed to this ring current source via the diodes D31 and D32 and the resistor R32 from the terminal 1 of the supply system, which input current flows off via the transistors T33 and T35 to the terminal 2 of the supply system. The collector of T34 supplies the output current (control current $I_s$ mentioned above) having the following magnitude:

$$I_s = \frac{U_T}{R33} \ln(m \cdot n),$$

wherein $U_T$ = temperature-voltage equivalent, m = quotient of the emitter surfaces of T33 and T34, n = quotient of the emitter surfaces of T36 and T35.

It can be seen that this control current $I_s$, which can be determined by the construction, is independent from the input current of the ring current source. Thus, the resistor R32 may be determined so as to have very high impedance and accordingly the input current of the ring current source may be determined so as to be very small without influencing the control current $I_s$ because of this. This advantageously contradicts the overriding aim of achieving the smallest possible inherent current consumption in standby operation. The dividing device A1, which is shown, can also be substituted with other constructions which supply a sufficiently suitable control current $I_s$.

The significance of the described additional feature for the branch point K consists in that this point provides an advantageous action point for the additional devices B, C, D, E and F at which these devices can interrupt or reduce the current flow through the transistor T3. For this purpose, only the very small control current be guided off at the branch point K for the supply terminal 1 and not the substantially larger base current of T3 which is to be rated for maximum load. For this reason, only the control current $I_s$ and not the base current of T3, which is to be rated for maximum load, goes into the inherent current consumption. The preliminary stage according to FIG. 5 does not contain the described additional feature; for this reason, the inherent current consumption of this preliminary stage is at least the magnitude of the base current of T3 necessary for maximum load. This preliminary stage is thus unsuitable for efficient standby operation.

The object of device B is to reduce the current flowing in the external capacitor C3 to zero before the longitudinal transistor T3 reaches saturation when the voltage difference of the supply voltage at the terminals 1 and 2, minus the voltage at C3, falls below an amount determined by the construction. The object described above under item b is accordingly met.

In the embodiment shown in FIG. 6, this function is produced by the transistor T41 together with the diodes D31 and D32. The base potential of T41 lies below the supply potential at terminal 1 by the amount of two diode forward voltages because of the diodes D31 and D32. Since the base-emitter junction of T41 itself requires a diode forward voltage in order to carry a sufficiently large emitter-collector current, which is subtracted from the control current $I_s$ and flows off via T3 to the supply terminal 1, the potential at the collector of T3 can only increase to a diode forward voltage below the potential at the supply terminal connection 1. That is, the control current $I_s$, and accordingly also the base current of T3, is then reduced by the current through T41 such that C3 can no longer be charged. The structural component parts R41 and C41 serve for frequency compensation of the control loop which is closed with the action of T41 and acts on the branch point K. The remaining range voltage from the amount of the diode forward voltage, which range voltage is determined by the construction, can be reduced (low-drop goal) in that e.g. a Schottky diode (with a smaller forward voltage) is selected for the diode D32.

Other constructions are also conceivable for this purpose. In particular, a lateral construction is selected for the transistor T3 in integrated circuits—because of its high blocking voltage load in both the forward and reverse directions: inside a region of one conductivity type lying close to the surface and forming the base region of transistor T3, two regions of another conductivity type, one of which forms the emitter region and the other forming the collector region of the transistor T3, are to be arranged next to one another (not one above the other). If a third region (auxiliary collector) of the other conductivity type is arranged in such a construction in such a way that the emitter, collector and auxiliary collector lie next to one another in this lateral sequence and the collector region completely encloses the emitter region laterally, the auxiliary collector then only carries current when the emitter-collector voltage of this arrangement has been reduced to values in the immediate vicinity of the emitter-collector saturation residual voltage. Thus, in this way, a reliable indication of the operation of T3 which is close to saturation is made possible. Thus, the auxiliary collector of T3 is now connected with the emitter of T41 (or directly with the branch point K) and equivalent solutions for the object of device B are accordingly obtained, wherein the differently constructed means for securing stability with respect to regulating technology are not discussed further.

It is the object of device C to limit the collector current of T3 to a maximum current which is predetermined by the construction.

In the embodiment according to FIG. 6, this object is met by the transistors T51, T52, T53, the diode D51, and the resistors R51 and R52. The base-emitter junctions of the two transistors T51 and T3 are connected directly in parallel, so that a (very small) proportional component of the emitter-collector current of T3 always flows through T51. The factor of proportionality is the emitter surface ratio q:p of the two transistors T51 and T3 ($q << p$). The current through T51 is compared at the base node of T53 with a fixed reference current $I_R$ which is produced in turn with T52 and R52 in a manner similar to the control current $I_s$ described earlier. If the current through T51 is greater than the reference current $I_R$, T53 becomes conductive and guides off the excessive portion of the control current $I_s$ offered at the branch point K via D31 to the supply connection 1. The maximum collector current of T3 is accordingly fixed at $I_R \cdot p:q$ in this embodiment example. The diode D51 prevents the saturation operation of T52; the resistor R 51 has significance only in terms of regulator technology.

The object of the device D is to limit the voltage at the external capacitor C3 to a maximum voltage $U_{3max}$ which is predetermined by the construction.

In the embodiment according to FIG. 6, this object is met by means of the transistors T61, 62, 63 and the Zener diodes D61 and D62. The sum of the Zener voltages of D51 and D62 provides a voltage threshold for the voltage at the capacitor C3 up to which the entire device D remains without current. If this voltage threshold, plus a certain base-emitter forward voltage of T63, is exceeded the current of T63 which is mirrored by means of the current mirror T61, T62 on the base node of T53 is greater than the reference current $I_R$ flowing off at the base node of T53. The regulating process is then the same as was already described for the device C, but with the effect that the voltage at C3 can not now increase beyond the amount of the aforementioned voltage threshold plus the certain base-emitter forward voltage of T63.

Alternative embodiments are immediately discernible: a direct connection of the collector T62 with the branch point K instead of the connection with the base node of T 53 results in approximately the same effect. In addition, a separate reference current source for the device D can be worked with—in a manner similar to device C—and can be connected with the branch point K via a T53 equivalent which is likewise separate.

The object of the device E is to block transistor T3 completely for the reverse operating direction, i.e. to eliminate the current flow through transistor T3 when the supply voltage between terminals 1 and 2 is smaller than the instantaneous charging voltage at C3.

In the embodiment according to FIG. 6, this object is met by means of transistors T71 and T72. The base-emitter junctions of these two transistors are connected in parallel and lie at the output connection 4 of the preliminary stage at their emitter side. The base potential of the two transistors is smaller than the potential at the supply connection 1 by an amount corresponding to the forward voltage of the diode D31. Thus, as soon as the supply voltage between the connections 1 and 2 is equal to or smaller than the instantaneous charging voltage at C3 (between the connections 2 and 4), the transistors T71 and T72 are conductive. The transistor T71 short circuits the collector-base junction of T3, which is functional with respect to the emitter-base junction in reverse operation, so that no inverse current can flow over T3. The control current $I_s$ is guided off from the conducting transistor T72 to the connection 4 so that the transistor T71 now need not absorb the control current $I_s$ increased via the device A2. The base current of the transistors T71 and T72 flows over the diode D32, the resistor R32 and the input side of the ring current source, described above, to the capacitor C3 (terminal 2) which now supplies the circuit as energy storage.

The object of the device F is to prevent the current flow over the transistor T3 by short circuiting its base-emitter junction when the supply voltage between the terminals 1 and 2 exceeds an amount which is determined by the construction. The required base-emitter short circuit for the transistor T3 increases its resistance to disturbance relative to high blocking voltages which can occur in this operating state of the preliminary stage.

In the embodiment according to FIG. 6, this object is met by the transistors T81, T82, T83, the resistor R81 and the Zener diode chain D81, D82, D83 and D84. If the supply voltage between the connections 1 and 2 exceeds the voltage threshold determined by the Zener voltages of the diode chain DD81 to D84, plus the forward voltage of the transistor T81 connected as a diode, the transistors T82 and T83 become conductive. The transistor T83 short circuits the base-emitter junction of the transistor T3 and accordingly prevents the current flow over T3. The transistor T82 guides off the control current $I_s$ to the supply connection 1 so that the transistor T83 need not receive a current amplified by means of the device A2. The resistor R81 limits the current flow in the Zener diode branch (protective function).

The transistor T84 is without function in this operating state (excess voltage) of the preliminary stage. Its object is similar to the object of transistor T71: blocking the transistor T83 for the reverse operation.

The invention, with respect to preliminary stage VS, is not limited to the special embodiments of the devices A, B, C, D, E and F described by with reference to FIG. 6. Rather, a virtually unlimited multitude is conceivable for these devices.

In many cases the characteristics of the preliminary stages described with reference to FIG. 6 are already sufficient for a trouble-free supply of electronic units from a disturbed supply system.

However, for microprocessors and data storages, stabilized voltages are required which are produced in the solution according to the invention with subsequent voltage regulators. Since these regulators now need no longer absorb any disturbances of the supply system (particularly high voltages of both kinds of polarity), they can be regulators which can be compensated internally, according to the principle of construction shown in FIG. 1, if their drop voltage up to 1.2 V need not be added to the drop voltage of the preliminary stage to the full extent.

Such a solution can be indicated.

A slight overall drop voltage is required by the characteristics of the preliminary stage only when the supply voltage is only slightly greater than the required stabilized output voltage for a longer period of time. However, it is precisely then that there is no high-voltage load, so that a regulator, according to FIG. 1, could be connected directly to the supply system for this case of operation. For the purpose of economizing on drop voltage, it is, of course, also sufficient to connect a device for the base current supply of the transistor T1 directly to the supply system in this case of operation in order to economize on the portion of the overall addition of drop voltage allotted to the latter.

Figure 4:
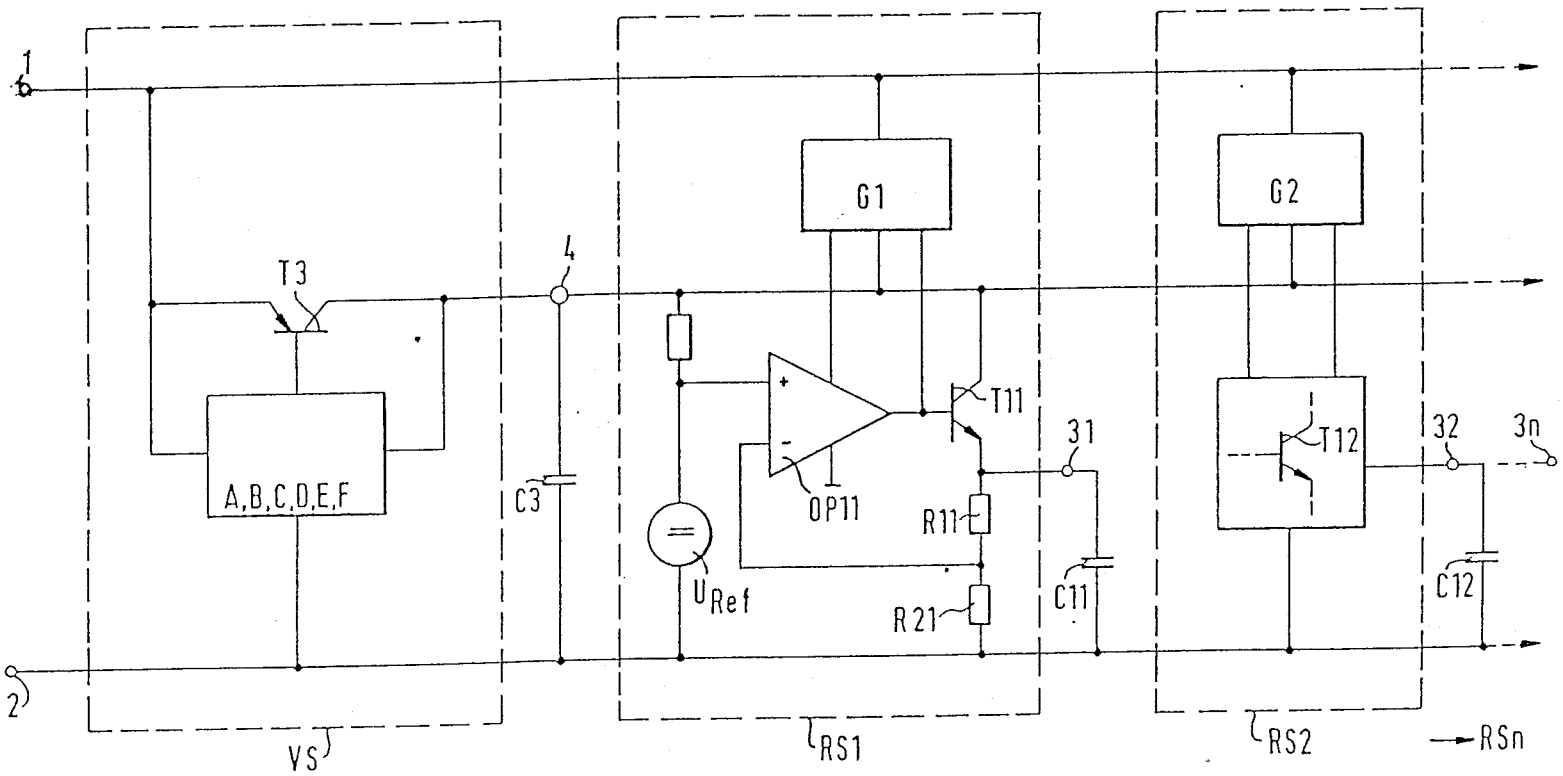
FIG. 4 shows a voltage regulator with a preliminary stage and subsequent regulator stages, according to the invention.

The object of the device G (G1, G2 . . . , etc.) is to provide the transistor T1 (T11, T12 . . . , etc.) in the series branch of an additional regulator stage RS (RS1, RS2 . . . , etc.; FIG. 4), which is connected subsequent to the preliminary stage VS, with base current in such a way that said base current is taken off from the main charge storage C3 as long as the voltage at C3 is sufficiently high for this, and in such a way that said base current is taken off directly from the terminal 1 of the supply system without intermediate storage in C3 when the voltage at C3 falls below an amount determined by means of the construction. The amount determined by means of the construction need not be constant.

Figure 7:
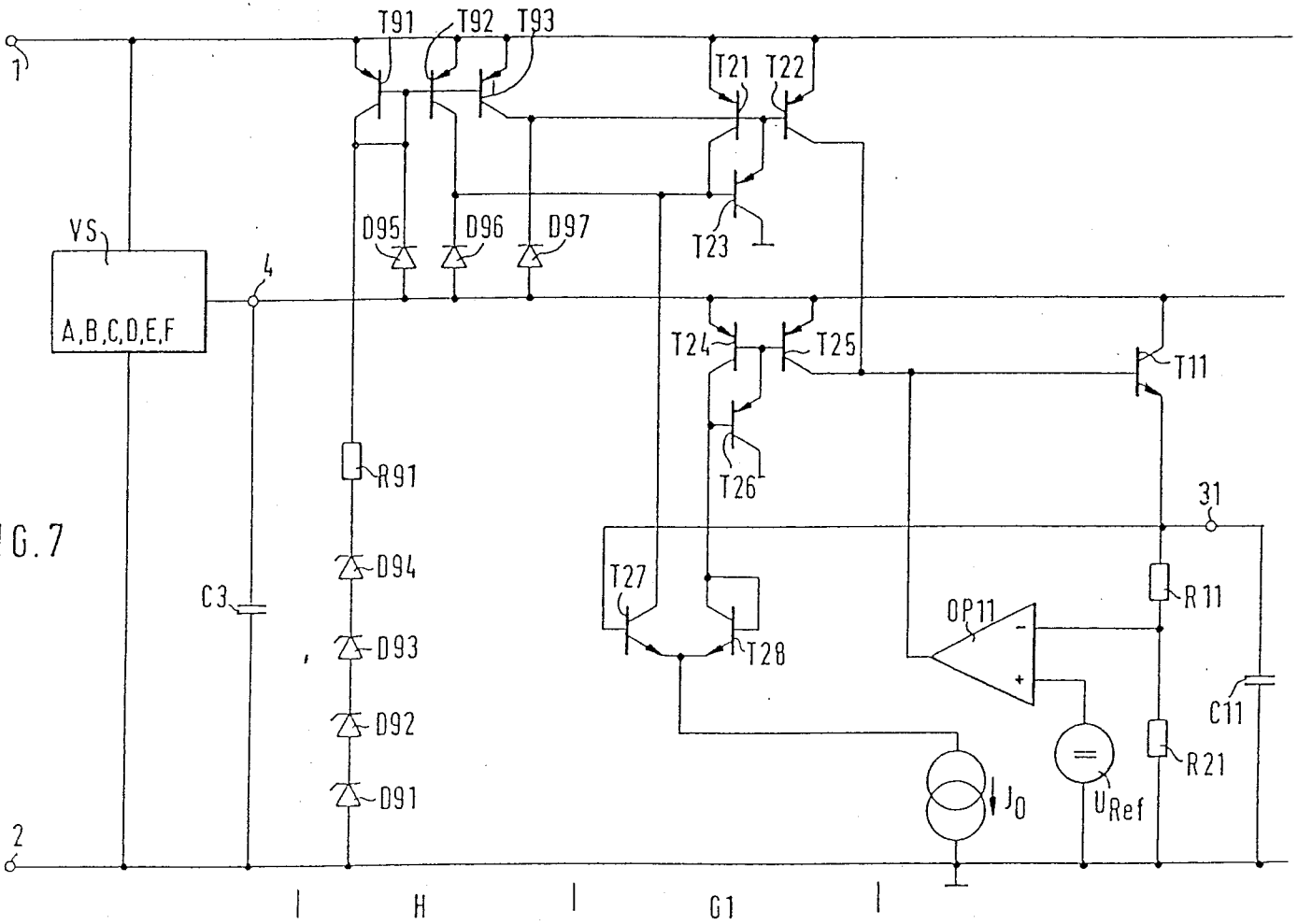
FIG. 7 shows an embodiment of a subsequent voltage stabilizing regulator stage, according to the invention.

In the embodiment example according to FIG. 7, this object is met by means of the arrangement with the transistors T21 to T28 characterized by G1. Besides the area characterized by G1, the following known components are shown, among others: the preliminary stage VS between the supply connections 1 and 2 with its output connection 4 and the main charge storage C3; further, another regulator stage which is connected subsequent to the preliminary stage VS in the construction, according to FIG. 1, with the longitudinal branch transistor T11 and the operational amplifier OP11, whose output carries the base potential of T11 in such a way that the stabilized output voltage (e.g. 5 V), which is adjustable with the voltage divider R11, R21, occurs at the output connection 31.

The current feed to the base of T11 is a component part of the device G1. Thus, it is sufficient if the output of OP11 can guide current away from the base connection of T11. The output of OP11 may be, but need not be, capable of feeding current to the base of T11.

The transistors T21, T22, and T23 and transistors T24, T25 and T26, respectively, form a current mirror with base current amplifier, the former obtaining its supply current from the supply terminal 1 and the latter obtaining its supply current, via the terminal 4, from the main charge storage C3. The outputs of the two current mirrors (collector of T22 and collector of T25) are connected with one another and with the base of T11 as well as with the output of OP11. Each of the two current mirrors must be capable in itself of supplying the maximum base current required by T11 at its output when it is triggered at its input by an input current $I_o$. In order to keep the required input current $I_o$ small, current mirrors which translate in an advantageous manner are selected which are then likewise advantageously equipped with the indicated base current amplifiers T23 and T26. The emitter-coupled transistor pair T27, T28 decides which of the two current mirror inputs is triggered by the input current $I_o$. By its base connections, this transistor pair compares the stabilized voltage at the output terminal 31 of the subsequent voltage regulator stage with the voltage at the terminal 4 of the main charge storage C3, which voltage is reduced by two diode forward voltages (those of T24 and T26). Thus, as long as the voltage difference between connection 4 and connection 31 is greater than the aforementioned forward voltage sum at T24, T26, the current $I_o$ over T28 is sent to the input of the current mirror T24, T25, T26, since there is then sufficient voltage available at C3 to cover the entire drop voltage of the subsequent voltage regulator stage from the voltage at C3. In this state, the current mirror T21, T22, T23 is not active; it is even advantageous to actively block it in the event of high voltage at the connection 1 in order to increase the blocking voltage strength of its transistors T21, T22, T23. The blocking signals necessary for this can be taken off e.g. from an analogous expansion of the device F of the preliminary stage, or they are produced separately in a device H with an object analogous to that of device F of the preliminary stage.

If the voltage difference between connection 4 and connection 31 is less than the aforementioned forward voltage sum at T24, T26, the current $I_o$ over T27 is then sent to the input of the current mirror T21, T22, T23, so that the drop voltage portion of the subsequent voltage regulator stage allotted to the base current supply of T11 is now covered by the supply voltage at the connection 1. Since this drop voltage portion is never greater than the drop voltage of the preliminary stage, there is no additional voltage loss for this portion.

It remains to be added that a first controlling current $I_o$ for the production of base current of the longitudinal branch transistor T11 must be contained in some manner in every voltage regulator. The source for $I_o$ is therefore not necessarily to be assigned to the device G, but rather to the subsequent voltage regulator stage.

The object of the device H is to actively block the current source of the device G supplied from the supply terminal 1, which current source supplies base current to the base of the transverse branch transistor T1 of a subsequent voltage regulator stage when the supply voltage between the terminals 1 and 2 exceeds an amount determined by the construction.

In the embodiment according to FIG. 7, this object is met by the transistors T91, T92, T93, the resistor R91, the Zener diode chain D91, D92, D93, D94 and the diodes D95, D96 and D97. With respect to the triggering of blocking, the device works in the same manner as was described with respect to the device F of the preliminary stage. The diodes D95, D96 and D97 block the transistors T92 and T93 for the inverse operation.

While the invention has been illustrated and described as embodied in a rpeliminary stage of a voltage regulator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A preliminary stage of a voltage regulator with a low voltage loss to be connected with a further stage of the voltage regulator, said preliminary stage comprising an input voltage terminal; an output voltage terminal; a common voltage terminal for input voltage and output voltage; a capacitor serving as a charge storage element at an output side of said preliminary stage, said capacitor having a first terminal connected with said output voltage terminal, and a second terminal connected with said common terminal for the input and output voltage;

a series branch including a transistor having an emitter connected with said input voltage terminal, a collector connected with said output voltage terminal, and an auxiliary collector; means for feeding said transistor with a base current such that said collector is able to supply a highest load current required at said output voltage terminal; means for limiting the output voltage of said preliminary stage of a voltage regulator occurring at said capacitor to a maximum output voltage; and means for reducing current flowing in said capacitor to zero before said transistor reaches saturation when the input voltage and the output voltage falls below a predetermined amount, said reducing means including means for influencing a potential of said collector and connected with said auxiliary collector and said input voltage terminal.

2. A preliminary stage of a voltage regulator as set forth in claim 1, further comprising first switching means for blocking current flow through said transistor for an inverse operating direction thereof by short circuiting a basis-collector junction of said transistor when the input voltage of said preliminary stage is less than the output voltage thereof.

3. A preliminary stage of a voltage regulator as set forth in claim 1, further comprising means for limiting collector current of said transistor to a predetermined maximum current.

4. A preliminary stage of a voltage regulator as set forth in claim 1, further comprising second switching means for blocking current flow through said transistor by short circuiting a base-emitter junction of said transistor when the input voltage of said preliminary stage exceeds a predetermined magnitude.

5. A preliminary stage of a voltage regulator as set forth in claim 1, wherein said base current feeding means includes first and second means and a nodal point at which said first and second means are connected with each other, said first means defining a current source for guiding off a current, which is substantially constant and small in comparison with a maximum base current of said transistor, from said nodel point to said common terminal, said second means defining a current amplifier connecting said nodel point with said base of said transistor in such a way that the base current fed to said base of said transistor, has a magnitude equal to the current from said first means multiplied by a current amplification factor of said second means when said base is not influenced by other elements of said preliminary stage.

6. A voltage regulator comprising a preliminary stage including an input voltage terminal, an output voltage terminal a common voltage terminal for input voltage and output voltage, a capacitor serving as a charge storage element at an output side of said preliminary stage, and having a first terminal connected with said output voltage terminal, and a second terminal connected with said common terminal for the input and output voltage, a series branch including a transistor having an emitter connected with said input voltage terminal, a collector connected with said output voltage terminal, and an auxiliary collector, means for feeding said transistor with a base current such that said collector is able to supply a highest load current required at said output voltage terminal, means for limiting the output voltage of said preliminary stage of a voltage regulator occurring at said capacitor to a maximum output voltage, and means for reducing current flowing in said capacitor to zero before said transistor reaches saturation when the input voltage and the output voltage falls below a predetermined amount, and including means for influencing a potential of said collector and connected with said auxiliary collector and said input voltage terminal; and at least one additional voltage regulator stage connected between said output voltage terminal of said preliminary stage and an output voltage terminal of a further regulator stage and having a series branch including a transistor having a collector connected with said output voltage terminal of said preliminary stage, and an emitter connected with the output voltage terminal of the further regulator stage.

7. A voltage regulator as set forth in claim 6, wherein said additional voltage regulator stage includes first auxiliary means connected with said input and output voltage terminals of said preliminary stage for feeding said transistor in said series branch of said additional voltage regulator stage with a base current through said output voltage terminal of said preliminary stage as long as voltage between said output voltage terminals of said preliminary and additional regulator stages is large enough for this purpose, and through said input voltage terminal of said preliminary stage when the voltage between said output voltage terminals of said preliminary and additional regulator stages falls below a predetermined magnitude.

8. A voltage regulator as set forth in claim 7, wherein said first auxiliary means includes a current source for feeding said transistor of said series branch of said additional regulator stage with a base current through said input voltage terminal, said current source having a transistor having a base-emitter junction, said regulator stage including auxiliary blocking means for short circuiting said base-emitter junction when the input voltage of said preliminary stage exceeds a predetermined magnitude.

* * * * *